US006853344B2

(12) United States Patent
Huor

(10) Patent No.: US 6,853,344 B2
(45) Date of Patent: Feb. 8, 2005

(54) RADIAL LINE SLOT ANTENNA

(75) Inventor: Ou Hok Huor, Kanagawa Prefecture (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/642,580

(22) Filed: Aug. 19, 2003

(65) Prior Publication Data

US 2004/0036660 A1 Feb. 26, 2004

(30) Foreign Application Priority Data

Aug. 21, 2002 (JP) ..... 2002-240163

(51) Int. Cl.[7] ..... H01Q 13/10
(52) U.S. Cl. ..... 343/767; 343/768; 343/769
(58) Field of Search ..... 343/767, 768, 343/769, 770

(56) References Cited

U.S. PATENT DOCUMENTS 5,175,561 A * 12/1992 Goto ..... 343/769
5,194,876 A * 3/1993 Schnetzer et al. ..... 343/769
6,124,833 A * 9/2000 Bialkowski et al. ..... 343/770
6,509,880 B2 * 1/2003 Sabet et al. ..... 343/770
6,750,826 B2 * 6/2004 Schultze et al. ..... 343/767

OTHER PUBLICATIONS

"Measurements of planar feed circuits for a radial line slot antenna". A. Akiyama et al., Proceedings of the 2000 IEICE General Conference, B–1–125, Mar. 2000.

"A Feeding Circuit for Concentric Arrays of Radial Line Slot Antenna", M. Ishii et al., Proceedings of the 2000 IEICE General Conference, B–1–128, Mar. 2000.

"A Rectangular–to–Radial Waveguide Transformer thorugh a Ring Slot for Excitation of a Rotating Mode", K. Sudo et al., Proceedings of the 2000 IEICE General Conference, B–1–126, Mar. 2000.

"Design of a Millimeter–wave Radial Line Slot Antenna Fed by a rectangular Waveguide through a Ring Slot", K. Sudo et al., Proceedings of the 2000 Communications Society Conference of IEICE, B–1–62, Sep. 2000.

* cited by examiner

*Primary Examiner*—Tan Ho
(74) *Attorney, Agent, or Firm*—Rabin & Berdo, P.C.

(57) ABSTRACT

In an RLS antenna, the present invention allows adjusting the optimum positional relationship between the feeder section of the feeder disk and the feeder section of the antenna disk, simply, quickly and at high accuracy by a visual check, so that mass production becomes possible, and an increase in performance and a decrease in cost are implemented. When the diameter of the antenna disk is D and the wavelength of the central frequency is λ, a marker of about 0.10λ or less is disposed in an area of 0.5 (D−4λ)−0.5D distant from the center. A through hole with a size (opening area) through which the marker can be viewed is disposed at a position the same as the position of the marker on the feeder disk. By visually confirming that the marker is positioned at the center of the through hole, the antenna disk is positioned and secured on the feeder disk.

14 Claims, 15 Drawing Sheets

FIG. 7a
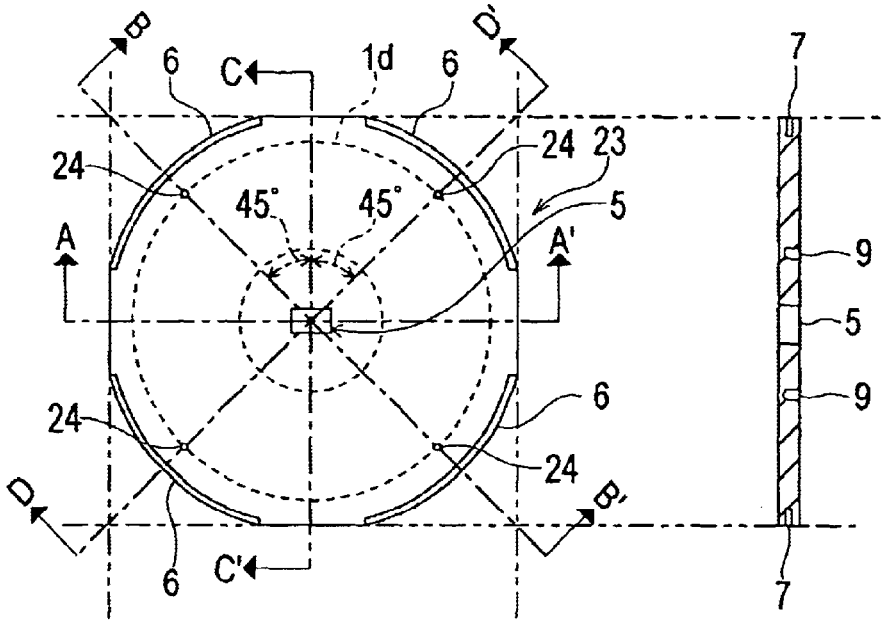
FIG. 7c
FIG. 7b
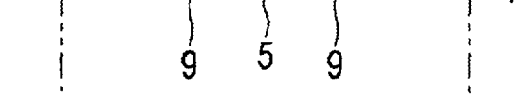
FIG. 7d
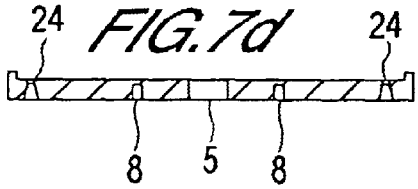
FIG. 7e
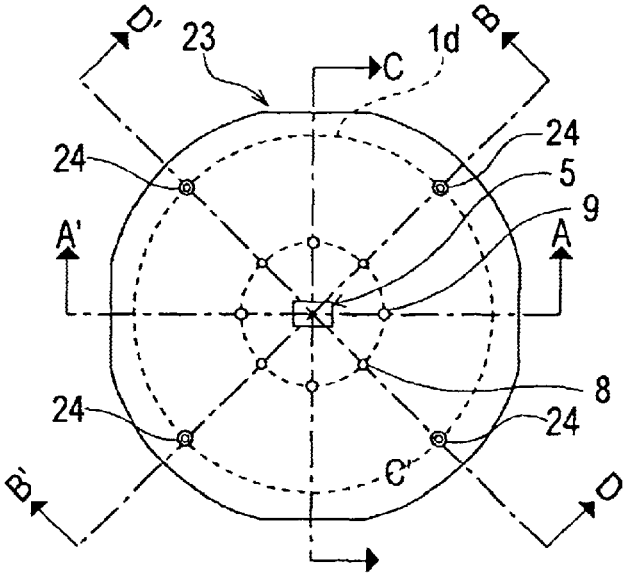

FIG.9a
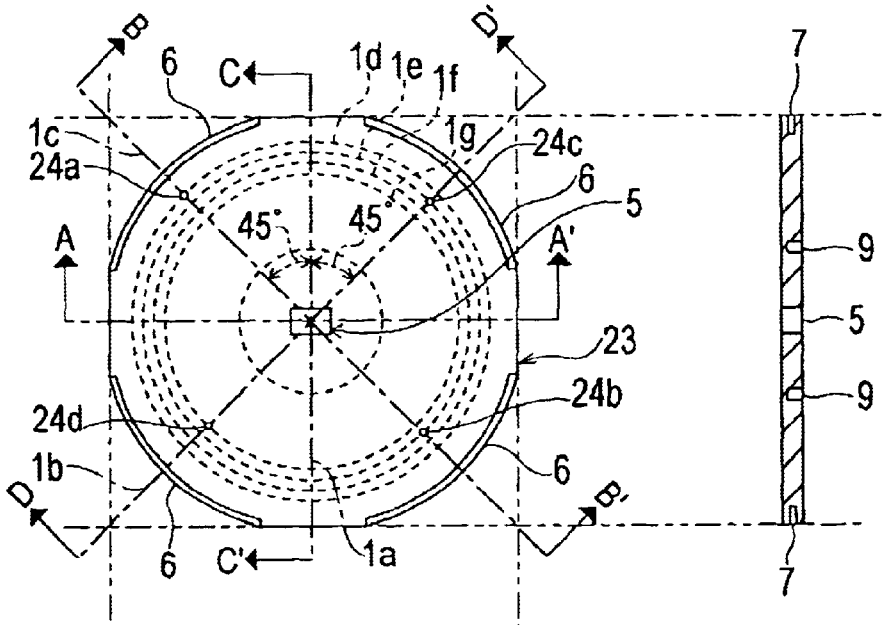
FIG.9c
FIG.9b
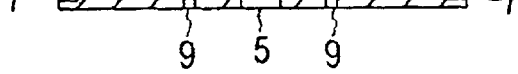
FIG.9d
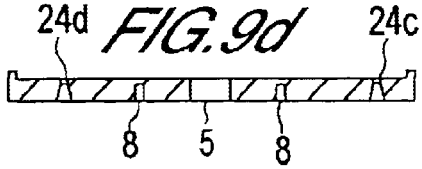
FIG.9f
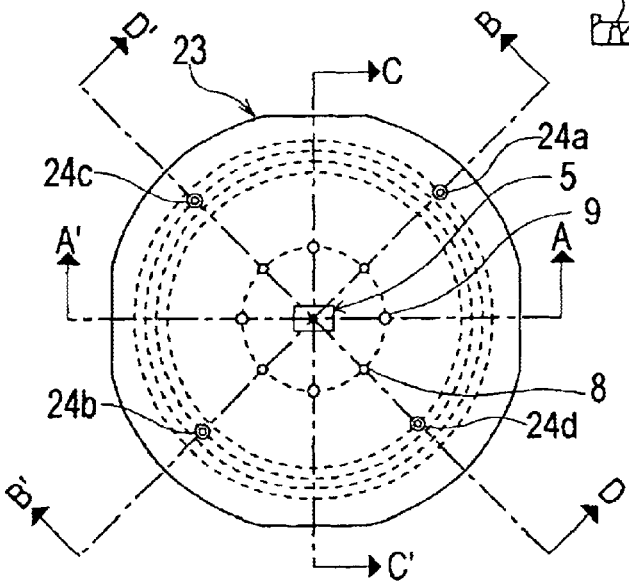
FIG.9e
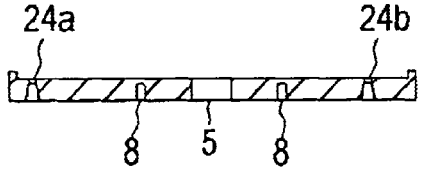

FIG. 10a
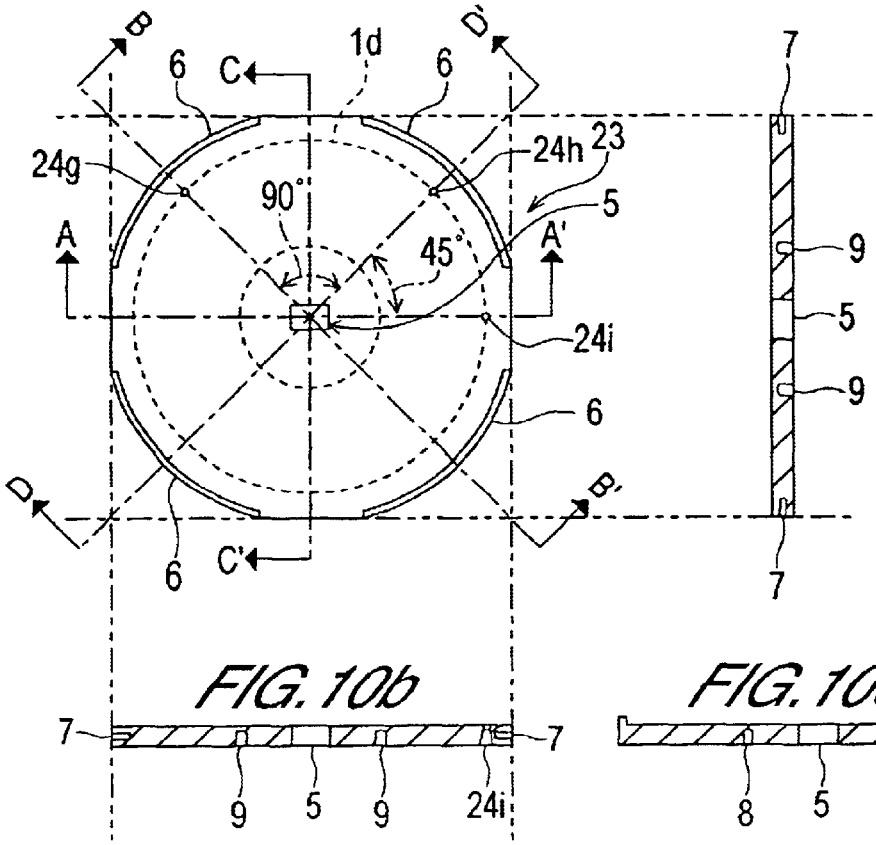
FIG. 10c
FIG. 10b
FIG. 10d
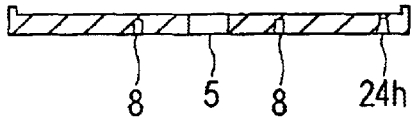
FIG. 10f
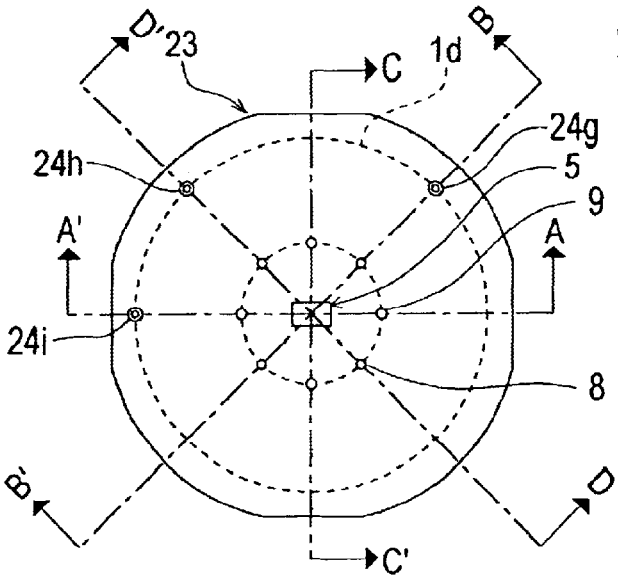
FIG. 10e
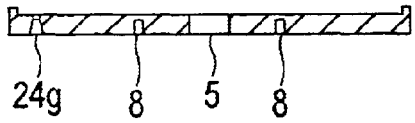

FIG. 12a
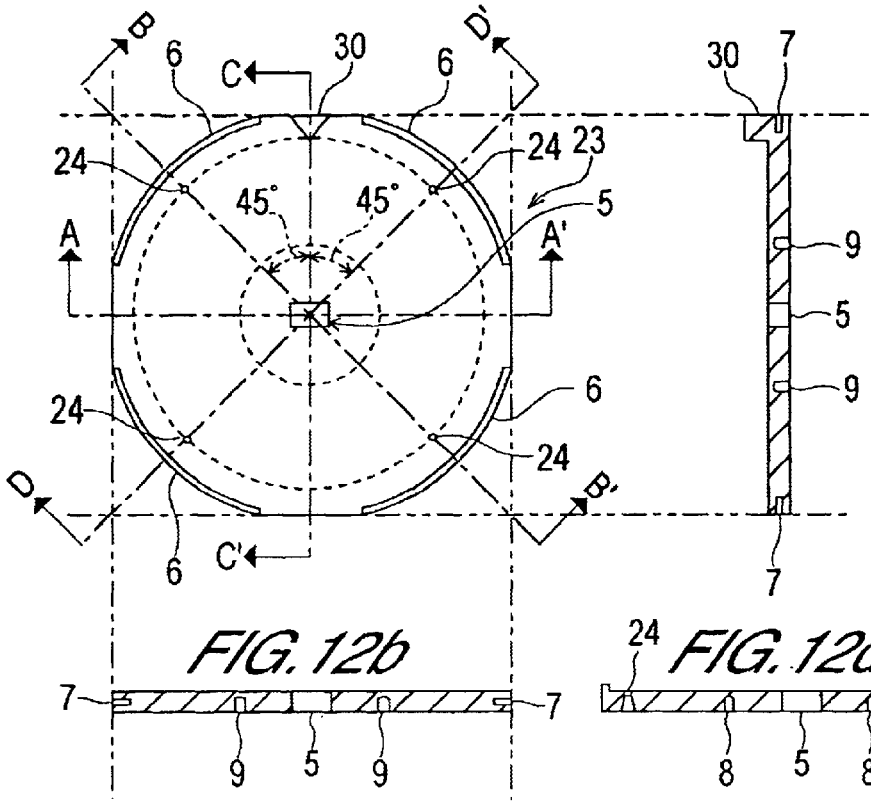
FIG. 12c
FIG. 12b
FIG. 12d
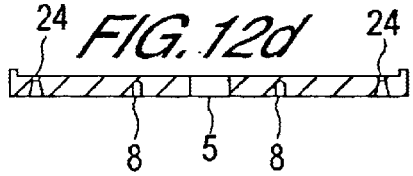
FIG. 12e
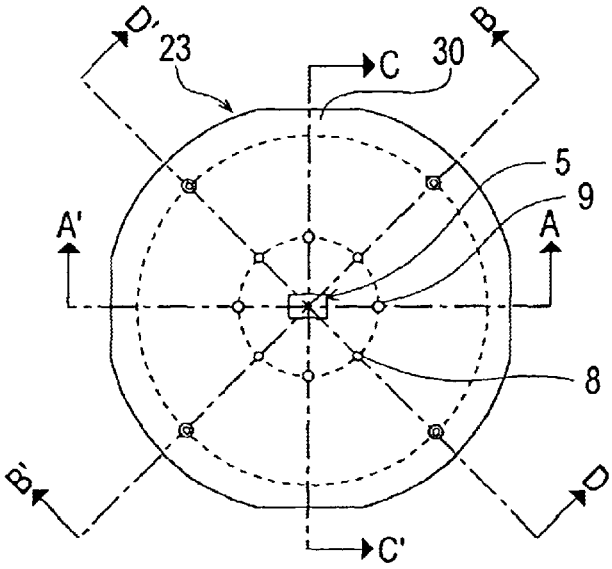

FIG. 14a
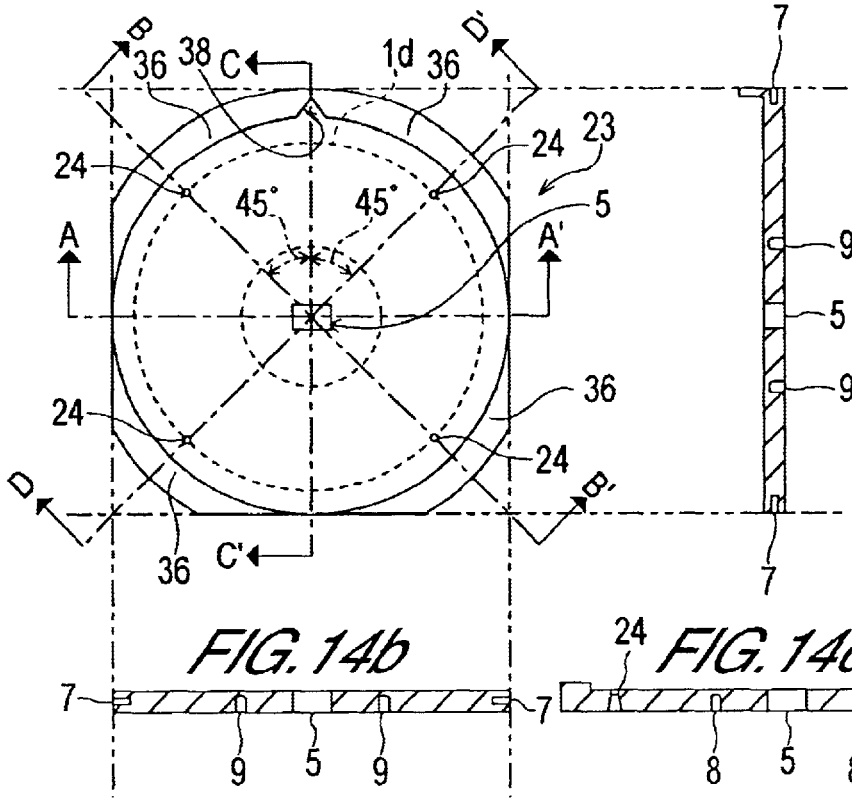
FIG. 14c
FIG. 14b
FIG. 14d
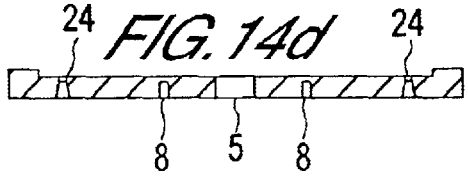
FIG. 14e
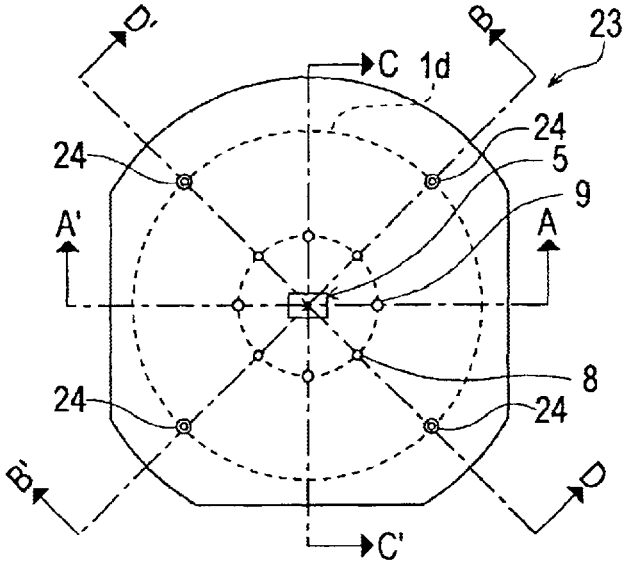

RADIAL LINE SLOT ANTENNA

BACKGROUND OF THE INVENTION

1. Field of the Invention

The present invention relates to a radial line slot antenna, and more particularly to a radial line slot antenna having an antenna disk which has a structure where a feeder section is disposed on the front side of the feeder disk comprising the feeder section.

2. Description of Related Art

Along with the remarkable development of radio communication technology, frequency bands allocated to various communication equipments tend to be insufficient recently. To effectively use frequencies in this situation, the development of a technology required for shifting to higher frequency bands is now an urgent issue.

For example, millimeter wave bands, which have been used almost exclusively for basic research, are now used for Intelligent Transport Systems (ITS). In the near future, in automobile based societies like Japan, the US and Europe, it is expected that millimeter wave band related communication equipment will be used just like home electronic equipment for general consumers.

In the above mentioned millimeter wave band communication field, it is inevitable that various electronic components and devices must be able to be used in millimeter wave bands. One of the most critical devices in this sense are antennas.

At the moment, research organizations and manufacturers world-wide who participate in the research and development of millimeter wave communication are competing in the development of high performance antennas for millimeter wave bands. Various types of configurations of millimeter wave band antennas have been developed so far. One that has very good characteristics among these antennas for millimeter wave bands is a radial line slot antenna (Reference 1: "Measurements of planar feed circuits for a radial line slot antenna", A. AKIYAMA, J. HIROKAWA, M. ANDO, Proceedings of the 2000 IEICE General Conference, B-1-125, March 2000 and Reference 2: "A Feeding Circuit for Concentric Arrays of Radial Line Slot Antenna", M. ISHII, T. KOSHIO, N. GOTO, Proceedings of the 2000 IEICE General Conference, B-1-128, March 2000).

This radial line slot antenna was developed as an antenna where the radiation characteristic has circular polarization.

This radial line slot antenna has many advantages, and is expected to play an important role as a millimeter wave band antenna for mobile communication, including radio LAN, in the near future.

The name of the radial line slot antenna is often simply referred to as "RLSA", which stands for Radial Line Slot Antenna. Herein below, the radial line slot antenna is referred to as an "RLS antenna" for description, in order to prevent confusion with other electronic components.

FIG. 1*a*–FIG. 1*c* are diagrams depicting the configuration of the antenna disk in a conventional RLS antenna. FIG. 1*a* is a plan view depicting the configuration of the front side of the antenna disk, and FIG. 1*b* is a plan view depicting the configuration of the rear side of the antenna disk. FIG. 1*c* is a side view depicting the configuration of the side face of the antenna disk.

The conventional antenna disks 1 shown in FIG. 1*a*–FIG. 1*c* are circular printed boards, which is a dielectric having the thickness characteristic to be described herein below. In this circular printed board, metallic foil (copper foil) on both the surfaces, front and back thereof, are processed. On the front side shown in FIG. 1*a*, many slots 2 comprised of two slot elements 2*a* and 2*b*, which do not cross and are created by etching processing, are arranged. These many slots 2 are arranged at equal intervals on a plurality of cocentric circumferences from the center of the antenna disk 1 to the periphery direction.

These slots 2 are created by etching processing such that the dielectric of the printed board is exposed. The many slots 2 are created such that the slot elements 2*a* and 2*b* form a right angle so as to radiate circular polarized waves.

The length and width of the two slot elements, which do not cross each other in a respective slot 2, the number of slots 2 in each circumference in the circular arrangement of the many slots 2, and the number of slots arranged in the circular shape, are determined depending on the specifications to obtain the radiation characteristic of a desired RLS antenna. These specifications are related to the thickness of the dielectric on the printed board, the dielectric constant thereof and the thickness of the metallic foil.

On the rear side of the antenna disk 1, the feeder section 3 is created by etching processing at the center of the antenna disk 1, as shown in FIG. 1*b*. This feeder section 3 is comprised of a ring slot and a perturbation element, which will be described herein below. The shape and dimensions of the ring slot and the perturbation element in the feeder section 3 are determined by the size of the feeder section in the feeder disk disposed between the feeder section 3 and the feeder wave guide.

The metallic foil (e.g. copper foil) which covers both the front and rear surfaces of the antenna disk 1 is in ground potential. To maintain this potential status, the metallic foil is coated on the side face portion of the antenna disk 1. This is to prevent the electromagnetic waves, which propagate through the dielectric, from leaking and radiating from the side face of the antenna disk 1.

FIG. 2*a* and FIG. 2*b* are plan views depicting the general configuration of the feeder section disposed on the rear side of the antenna disk. FIG. 2*a* is a plan view depicting an enlarged configuration of the rear side of the antenna disk, and FIG. 2*b* is a plan view depicting an enlarged configuration of the feeder section 3.

The feeder section 3 shown in FIG. 2*a* is comprised of the ring slot 3*a* and the perturbation element 3*b*, as shown in FIG. 2*b*. The ring slot 3*a* is created with the central axis of the antenna disk 1 as the center, which is a ring shape having a predetermined width and diameter defined considering the impedance related to the operating frequency, and is created by etching the metallic foil.

The perturbation element 3*b* is created with the central axis of the antenna disk 1 as the center, just like the ring slot 3*a*, which is a rectangular shape having a predetermined length and width defined considering the impedance related to the operating frequency, and is created by etching the metallic foil. This perturbation element 3*b* is disposed with angle θ of inclination in the counterclockwise direction from the virtual principal line 1*a* in the Y axis direction in the plane of FIG. 2*a* (Reference 3: "A Rectangular-to-Radial Waveguide Transformer through a Ring Slot for Excitation of a Rotating Mode", K. SUDO, J. HIROKAWA, M. ANDO, Proceedings of the 2000 IEICE General Conference, B-1-126, March 2000 and Reference 4: "Design of a Millimeter-wave Radial Line Slot Antenna Fed by a Rectangular Waveguide through a Ring Slot", K. SUDO, A. AKIYAMA, J. HIROKAWA, M. ANDO, Proceedings of the 2000 Communications Society Conference of IEICE, B-1-62, September 2000).

The arrangement and size of the ring slot 3*a* and the perturbation element 3*b* and the angle θ of the perturbation element 3*b* are demanded to be highly accurate, since the input impedance of an entire RLS antenna is determined by the dimensions of the feeder section of the feeder disk, to be described herein below.

If the operating frequency is in the 40 GHz band, for example, the above mentioned angle θ is 30 some degrees, but for the accuracy of the 30 some degrees, a first decimal place level of accuracy is required.

FIG. 3*a*–FIG. 3*e* are diagrams depicting the general configuration of a conventional feeder disk. FIG. 3*a* is a plan view depicting the configuration of the front side of the feeder disk, and FIG. 3*b* is a diagram depicting the configuration of the A-A' cutting plane (cross-section) of the feeder disk. FIG. 3*c* is a diagram depicting the configuration of the C-C' cutting plane of the feeder disk, and FIG. 3*d* is a diagram depicting the configuration of the B-B' and D-D' cutting planes of the feeder disk. And FIG. 3*e* is a plan view depicting the configuration of the rear side of the feeder disk.

The feeder disk 4 shown in FIG. 3*a*–FIG. 3*e* is created with a 5 mm or thicker brass material. In the feeder disk 4, the entire shape, particularly the flat part, has the size and shape whereby the antenna disk 1, described with reference to FIG. 1*a*–FIG. 1*c*, can be disposed. The feeder disk 4 has a rectangular feeder section 5 which passes through the feeder disk 4 in the central axis direction. This feeder section 5 matches the ring slot 3*a* and the perturbation element 3*b* in the feeder section 3 of the antenna disk 1, and has a size with dimensions which matches the impedance in the operating frequency thereof. To avoid a confusion of terms, the feeder section 3 may be referred to as the first feeder section, and the feeder section 5 as the second feeder section respectively.

On the periphery of the front side edge of the feeder disk 4, side stoppers 6 are disposed such that the size between the inner wall faces becomes several tens of μm larger than the diameter of the antenna disk 1, as shown in FIG. 3*a* and FIG. 3*d*.

When the antenna disk 1 is housed inside the side stoppers 6, the center of the antenna disk 1 and the center of the second feeder section 5 match. On the side face of the feeder disk 4, screw holes 7 for securing the entire RLS antenna to another device (not illustrated) are disposed, as shown in FIG. 3*b* and FIG. 3*c*. On the rear side, the pin holes 8 for aligning with the feeder wave guide, which is described later, and the screw holes for installation are disposed, as shown in FIG. 3*e*.

Now the assembly of the RLS antenna will be described with reference to FIG. 4*a*, FIG. 4*b* and FIG. 5.

FIG. 4*a* and FIG. 4*b* are diagrams depicting the RLS antenna assembly status, which is shown as cross-sections, and FIG. 5 is an enlarged plan view depicting the positional relationship between the feeder section (first feeder section) of the antenna disk, the feeder section (second feeder section) of the feeder disk, and the opening of the feeder wave guide. FIG. 5 is a plan view depicting the configuration from the feeder wave guide side.

At first in FIG. 4*a*, FIG. 4*b* and FIG. 5, the antenna disk 1 is housed inside the side stoppers 6 of the feeder disk 4, so that the front face of the feeder disk 4 and the rear face of the antenna disk 1 match. In this case, the center of the antenna disk 1 and the center of the feeder disk 4 are matched by the side stoppers 6. Since the angle of the perturbation element 3*b* of the first feeder section 3, created on the rear side of the antenna disk 1, is not a predetermined angle θ, the positional angle of the antenna disk 1 is fine-adjusted, while checking the reflection loss characteristic of the antenna.

Also the angle of the perturbation element 3*b* is set to a predetermined angle θ by fine adjustment. Then the antenna disk 1 is electrically bonded to the feeder disk 4 by a conductive adhesive or a conductive adhesive sheet.

In this case, a liquid conductive adhesive or a conductive adhesive sheet, which are not initially adhesive and which are adhered by air drying or heating after alignment, are used.

Then as FIG. 4*b* shows, the pins 13 of the feeder wave guide 11 are inserted into the pin holes 8 created on the front side of the feeder disk 4, so that the directions of the second feeder section 5 of the feeder disk 4, where the antenna disk 1 is mounted, and the opening 12 of the feeder wave guide 11, match.

And the screws 15 are screwed into the screw holes 9 of the feeder disk 4 respectively via the four screw holes 14 created in the feeder wave guide 11 to secure the feeder disk 4, where the antenna disk 1 is mounted, to the feeder wave guide 11.

When the RLS antenna assembled in this way is viewed from the feeder wave guide side, the center of the ring slot 3*a* is positioned on the common central axis of the second feeder section 5 (broken line) and the opening 12, and the angle of the perturbation element 3*b* is a θ angle included from the virtual principal line 1*a*. FIG. 4*b* shows the RLS antenna radiation directivity 16 after completion.

For this RLS antenna of the prior art, the ring slot 3*a* and the perturbation element 3*b* disposed on the rear side of the antenna disk 1 must match with the second feeder section 5 of the feeder disk 4 at high accuracy to correctly match the impedance of the second feeder section 5. For this, the angle of the antenna disk 1 is fine-adjusted while measuring and confirming the reflection loss characteristic or the impedance characteristic of the antenna as described above. In this case, it takes an enormous amount of time for this fine adjustment.

For the fine adjustment of the angle of the antenna disk 1, the antenna disk 1 may be mounted on the feeder disk 4 using various instruments appropriate for the RLS antenna shape so as to improve accuracy thereof, but in this case as well, it takes an enormous amount of time for adjustment, and a high accuracy adjustment and decreasing the RLS antenna cost are difficult. In other words, decreasing price and increasing the performance of an RLS antenna cannot be easily implemented.

SUMMARY OF THE INVENTION

With the foregoing in view, it is an object of the present invention to provide a radial line slot antenna where an optimum positional relationship between the feeder section of the feeder disk and the feeder section of the antenna disk can be adjusted, easily, quickly and at high precision by a visual check, and therefore the mass production of RLS antennas is possible, and increasing the performance and decreasing cost are implemented with certainty.

To achieve this object, the radial line slot antenna of the present invention comprises an antenna disk which has a slot element for transmitting/receiving electromagnetic waves on the front side, and has a feeder section at the center of the rear side, the opposite side of the front side, and a feeder disk where the antenna disk is mounted with the rear face thereof contact, and a feeder section for transmitting/receiving electromagnetic wave signals to/from the antenna disk is disposed, wherein when the diameter of the antenna disk is D and the wavelength of the central frequency is λ, a marker with the maximum size is about 0.10λ or less is disposed at an area at about 0.5 (D−λ) to 0.5 D from the center on the rear side of the antenna disk, and the feeder disk further comprises a through hole with a size sufficient to view the marker at a position the same as the position of the marker, and the antenna disk is positioned on the feeder disk after confirming that the marker is positioned at the center of the through hole.

In the present invention, when the rear face of the antenna disk and the front face of the feeder disk are aligned, it is confirmed that a marker created on the rear side of the antenna disk is positioned at the center of the through hole of the feeder disk before mounting the antenna disk on the feeder disk. By creating a marker for alignment on the rear side of the antenna disk like this, an optimum positional relationship between the feeder section of the feeder disk and the feeder section of the antenna disk can be adjusted, easily, quickly and at high precision by a visual check. As a result, mass production of RLS antennas become possible, and increasing performance and decreasing cost thereof can be implemented with certainty.

BRIEF DESCRIPTION OF THE DRAWINGS

The foregoings and other objects, features and advantageous of the present invention will be better understood from the following description taken in connection with the accompanying drawings, in which:

FIG. 1 are diagrams depicting a general configuration of an antenna disk in a conventional RLS antenna, wherein

FIG. 2 is a plan view depicting the general configuration of the feeder section disposed on the front side of a conventional antenna disk, wherein

FIG. 3 are diagrams depicting the general configuration of a conventional feeder disk, wherein

FIG. 7 are diagrams depicting the general configuration of the RLS antenna feeder disk according to the first embodiment, wherein FIG. 7*a* is a plan view depicting the configuration of the front side of the feeder disk, FIG. 7*b* is a diagram depicting the configuration of the A-A' cutting plane of the feeder disk, FIG. 7*c* is a diagram depicting the configuration of the C-C' cutting plane of the feeder disk, FIG. 7*d* is a diagram depicting the configuration of the B-B' and D-D' cutting plane of the feeder disk, and FIG. 7*e* is a plan view depicting the configuration of the rear side of the feeder disk;

FIG. 9 are diagrams depicting the general configuration of the RLS antenna feeder disk according to the second embodiment, wherein FIG. 9*a* is a plan view depicting the configuration of the front side of the feeder disk, FIG. 9*b* is a diagram depicting the configuration of the A-A' cutting plane of the feeder disk, FIG. 9*c* is a diagram depicting the configuration of the C-C' cutting plane of the feeder disk, FIG. 9*d* is a diagram depicting the configuration of the D-D' cutting plane of the feeder disk, FIG. 9*e* is a diagram depicting the configuration of the B-B' cutting plane of the feeder disk, and FIG. 9*f* is a plan view depicting the configuration of the rear side of the feeder disk;

FIG. 10 are diagrams depicting the general configuration of the RLS antenna feeder disk according to the fourth embodiment of the present invention, wherein FIG. 10*a* is a plan view depicting the configuration of the front side of the feeder disk, FIG. 10*b* is a diagram depicting the configuration of the A-A' cutting plane of the feeder disk, FIG. 10*c* is a diagram depicting the configuration of the C-C' cutting plane of the feeder disk, FIG. 10*d* is a diagram depicting the configuration of the D-D' cutting plane of the feeder disk, FIG. 10*e* is a diagram depicting the configuration of the B-B' cutting plane of the feeder disk, and FIG. 10*f* is a plan view depicting the rear side of the feeder disk;

FIG. 12 are diagrams depicting the general configuration of the RLS antenna feeder disk according to the fifth embodiment, wherein FIG. 12*a* is a plan view depicting the configuration of the front side of the feeder disk, FIG. 12*b* is a diagram depicting the configuration of the A-A' cutting plane of the feeder disk, FIG. 12*c* is a diagram depicting the configuration of the C-C' cutting plane of the feeder disk, FIG. 12*d* is a diagram depicting the configuration of the B-B' and D-D' cutting plane of the feeder disk, and FIG. 12*e* is a plan view depicting the configuration of the rear side of the feeder disk;

FIG. 14 are diagrams depicting the general configuration of the RLS antenna feeder disk according to the sixth embodiment, wherein FIG. 14*a* is a plan view depicting the configuration of the front side of the feeder disk, FIG. 14*b* is a diagram depicting the configuration of the A-A' cutting plane of the feeder disk, FIG. 14*c* is a diagram depicting the configuration of the C-C' cutting plane of the feeder disk, FIG. 14*d* is a diagram depicting the configuration of the B-B' and D-D' cutting plane of the feeder disk, and FIG. 14*e* is a plan view depicting the configuration of the rear side of the feeder disk.

DESCRIPTION OF THE PREFERRED EMBODIMENTS

Embodiments of the present invention will now be described with reference to the accompany drawings.

First Embodiment

Figure 6:
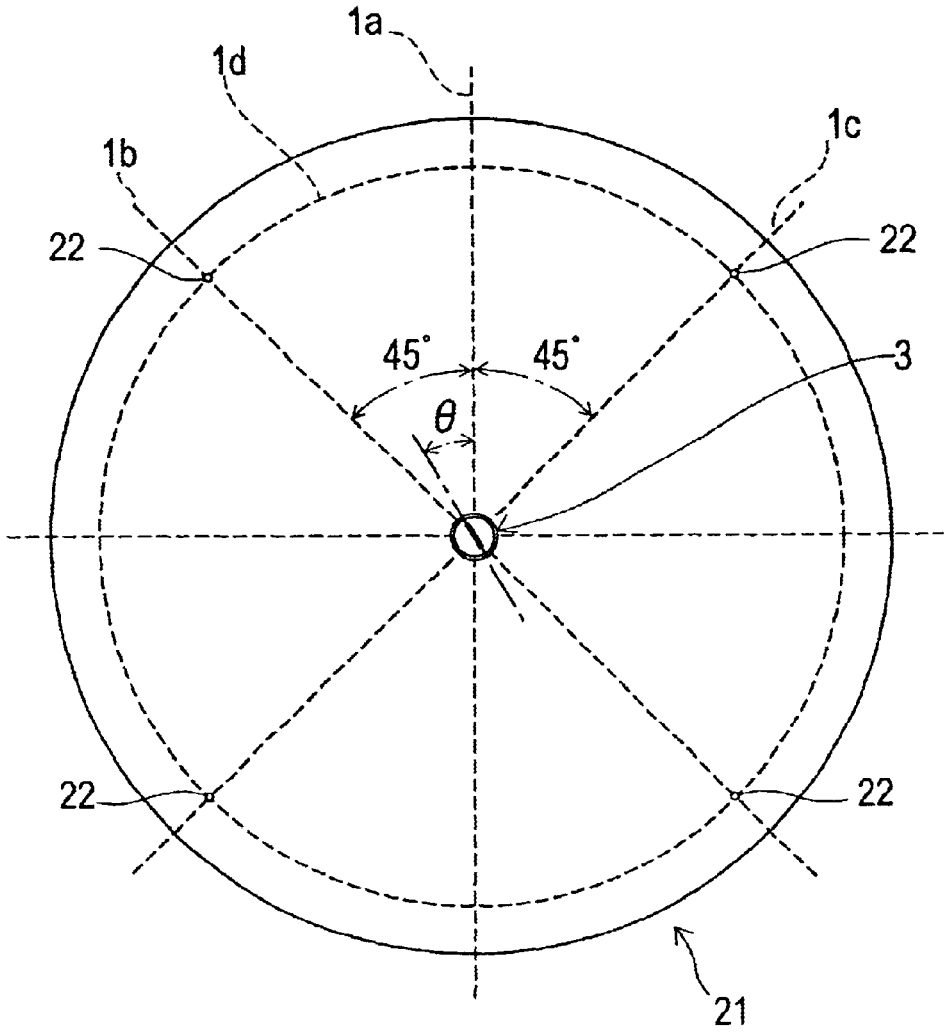
FIG. 6 is a plan view depicting the general configuration of the rear side of the antenna disk in the first embodiment of the RLS antenna feeder disk according to the present invention.

FIG. 6 is a plan view depicting the configuration of the rear side of the antenna disk 21 in the first embodiment of the RLS antenna according to the present invention.

FIG. 7 are diagrams depicting the configuration of the RLS antenna feeder disk according to the first embodiment. FIG. 7*a* is a plan view depicting the configuration of the front side of the feeder disk, and FIG. 7*b* is a diagram depicting the configuration of the A-A' cutting plane of the feeder disk. FIG. 7*c* is a diagram depicting the configuration of the C-C' cutting plane of the feeder disk, and FIG. 7*d* is a diagram depicting the configuration of the B-B' and D-D' cutting planes of the feeder disk. And FIG. 7*e* is a plan view depicting the configuration of the rear side of the feeder disk.

In FIG. 6 and FIG. 7, composing elements identical with or equivalent to the above mentioned prior art described with reference to FIG. 1 to FIG. 4 are denoted with identical reference numerals, for which redundant descriptions are omitted.

In FIG. 6 and FIG. 7, on the rear side of the antenna disk 21 in the first embodiment, the first feeder section 3, which comprises a ring slot 3*a* and a perturbation element 3*b* (see FIG. 5) at the center, and four markers 22, for example, which are arranged from the center to the circumference direction, are disposed just like the above mentioned prior art.

This marker 22 is created by etching processing, and has a circular shape where the diameter is the operating frequency 0.05λ, for example. This marker 22 is arranged at the intersection of the two virtual principal lines 1*b* and 1*c*, which are perpendicular to the central axis, and are inclined 45 degrees on both sides with respect to the virtual principal line 1*a* forming angle θ with the perturbation element 3*b*, and the virtual circumference 1*d*, where the diameter of the antenna disk 21 is D and the radius is 0.5 (D−2λ) when the wavelength of the central frequency of the RLS antenna is λ, respectively. These numeric values are based on the fact that creating markers with a maximum size of 0.1λ in the area within about 2λ from the outermost circumference, that is the edge, of the antenna disk 21, does not cause a negative influence on the antenna radiation characteristic and the impedance characteristic.

The above mentioned ring slot 3*a*, the perturbation element 3*b* and the marker 22 are simultaneously created by etching processing. In this creation, the accuracy of the dimensions and positions is extremely high, where error is about 50 μm.

The copper foil covering the surface of this antenna disk 21 must have ground potential. To maintain this potential status, the side face portion of the antenna disk 21 is covered with metallic foil. The metallic foil of this side face portion is to prevent the leak of electromagnetic waves propagating through the dielectric from the side face of the antenna disk 21.

Figure 1A:
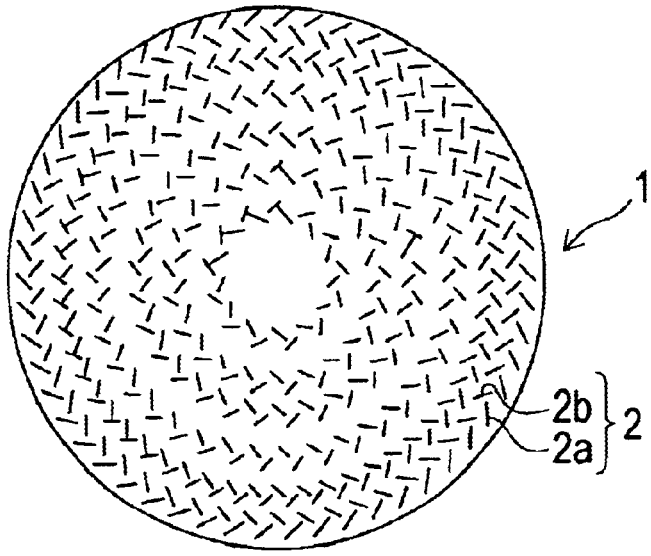
FIG. 1a Prior Art
FIG. 1*a* is a plan view depicting the configuration of the front side of the antenna disk.
Figure 1B:
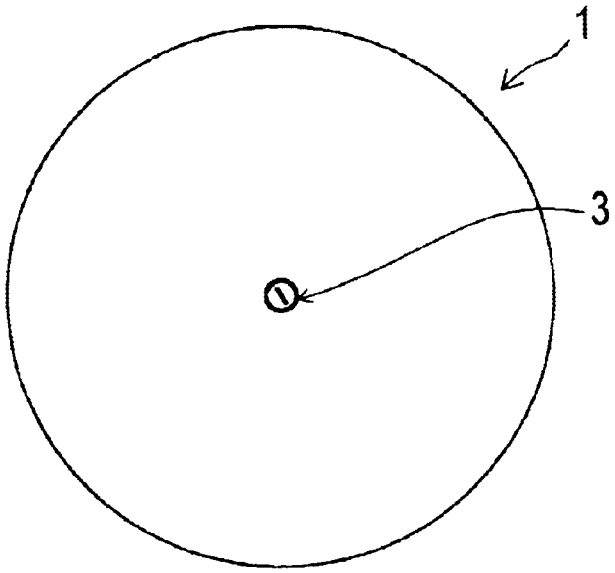
FIG. 1b Prior Art
FIG. 1*b* is a plan view depicting the configuration of the rear side of the antenna disk.
Figure 1C:
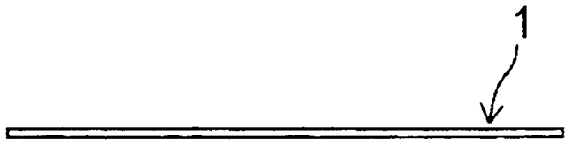
FIG. 1c Prior Art
FIG. 1*c* is a side view depicting the configuration of the side face of the antenna disk.
Figure 2A:
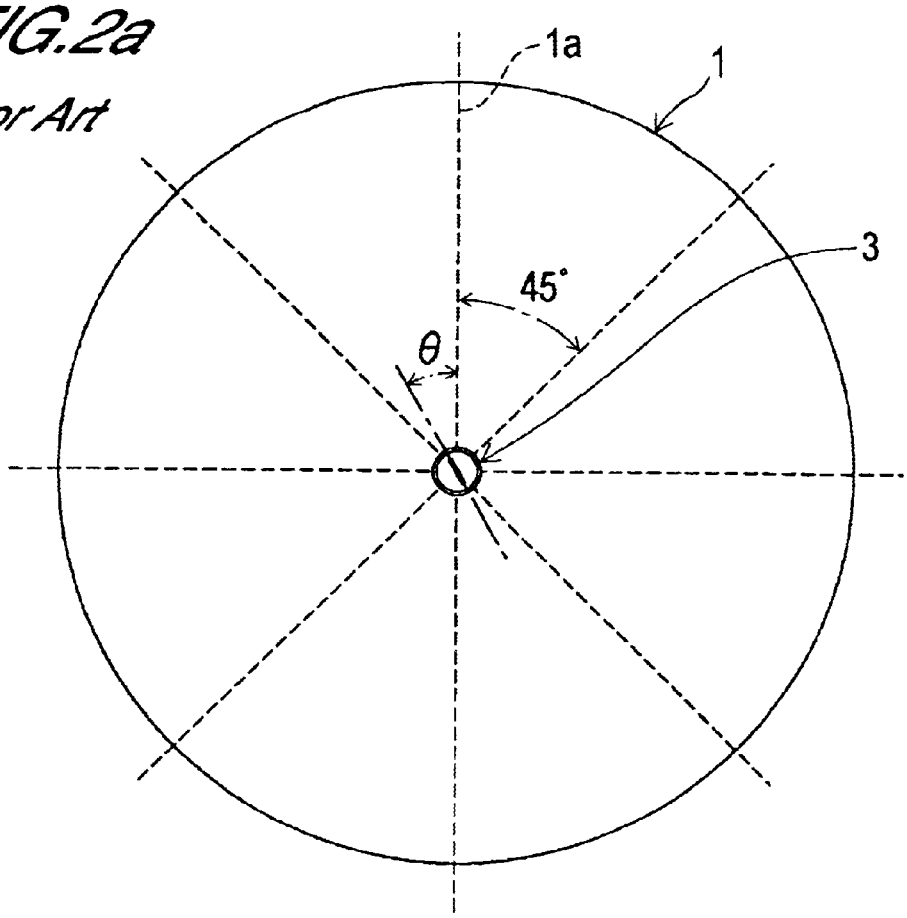
FIG.2a Prior Art
FIG. 2*a* is a plan view depicting an enlarged configuration of the rear face of the antenna disk.
Figure 2B:
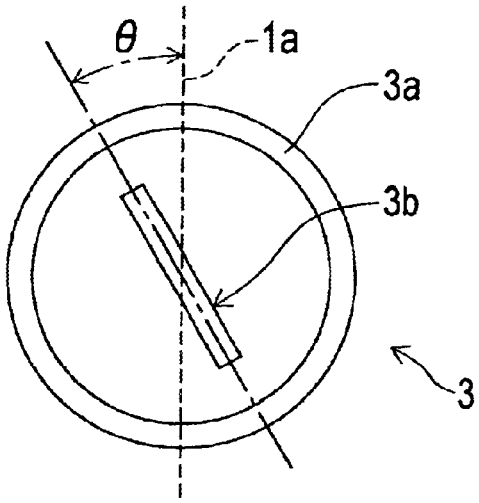
FIG.2b Prior Art
FIG. 2*b* is a plan view depicting an enlarged configuration of the feeder section.
Figure 3A:
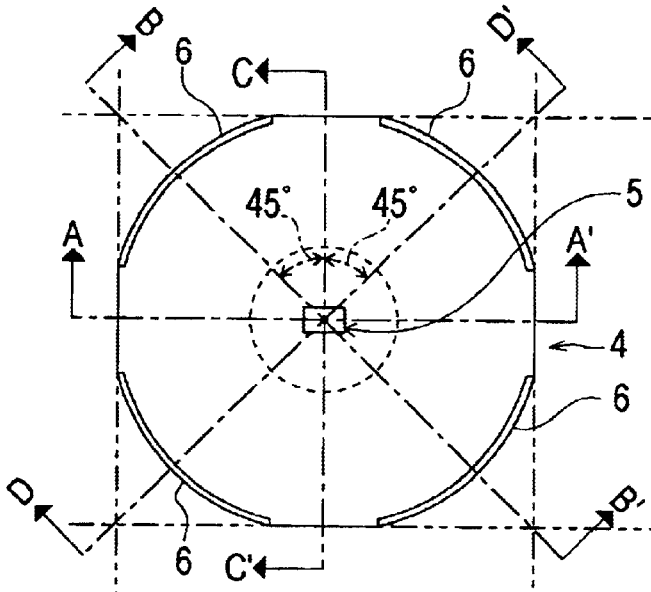
FIG. 3a Prior Art
FIG. 3*a* is a plan view depicting the configuration of the front side of the feeder disk.
Figure 3C:
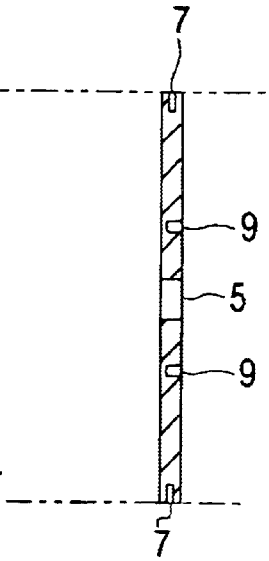
FIG. 3c Prior Art
FIG. 3*c* is a diagram depicting the configuration of the C-C' cutting plane of the feeder disk.
Figure 3B:
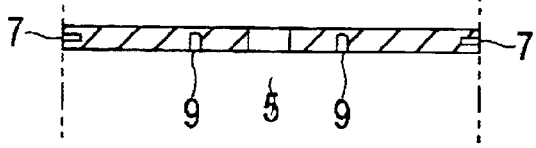
FIG. 3b Prior Art
FIG. 3*b* is a diagram depicting the configuration of the A-A' cutting plane of the feeder disk.
Figure 3D:
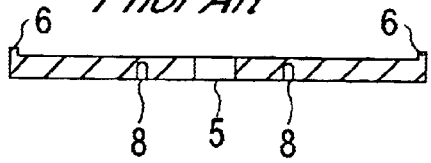
FIG. 3d Prior Art
FIG. 3*d* is diagram depicting the configuration of the B-B' and D-D' cutting planes.
Figure 3E:
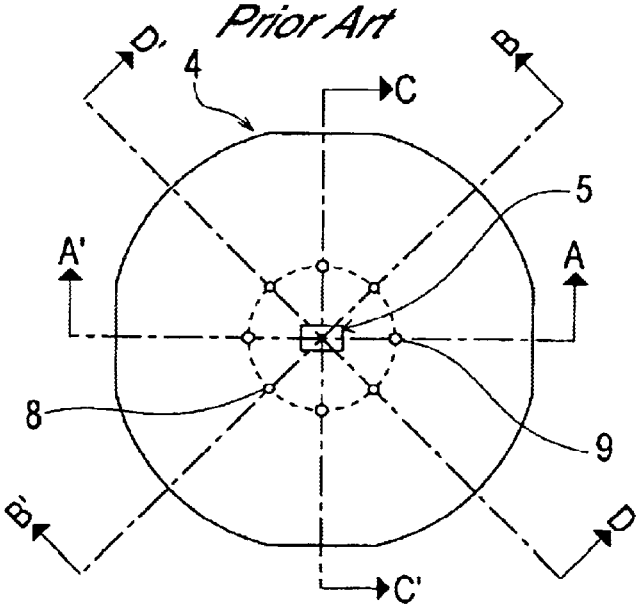
FIG. 3e Prior Art
FIG. 3*e* is a plan view depicting the configuration of the rear side of the feeder disk.
Figure 4A:
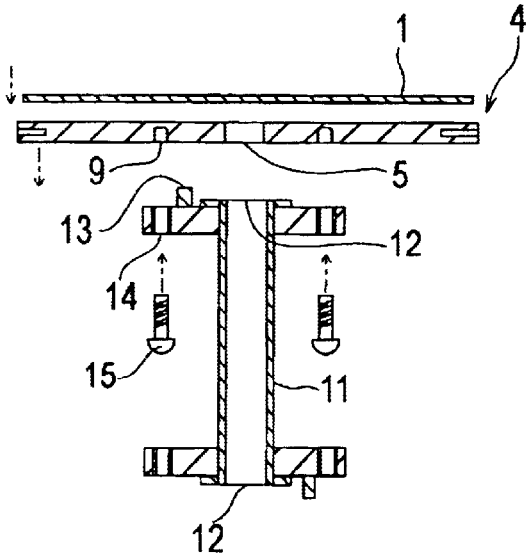
FIG. 4a Prior Art
FIG. 4 is a diagram of a cross-section depicting the RLS antenna assembly status.
Figure 4B:
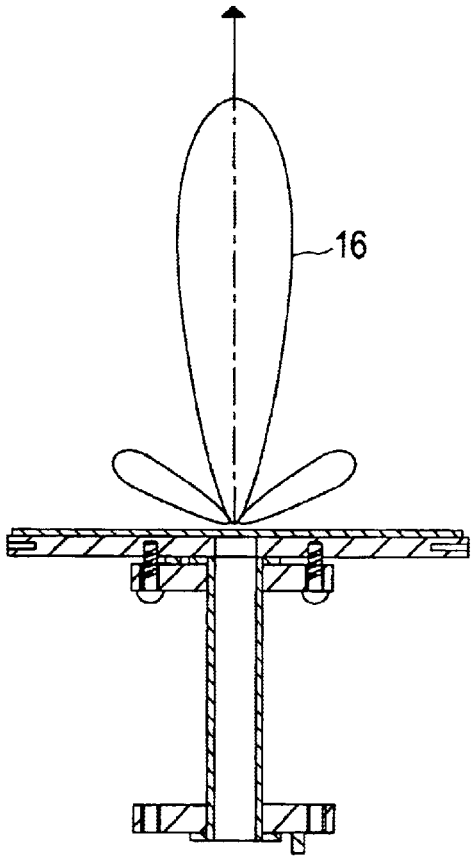
FIG. 4b Prior Art

If the electromagnetic waves are leaked from the side face of the antenna disk 21, the radiation pattern shown in FIG. 4*b* is affected, and the main beam and the side lobe (radiation pattern characteristic) deteriorate.

The above mentioned metallic foil on the side face portion of the antenna disk 21 is electrically connected with the copper foil, which covers both the front and back faces of the antenna disk 21. This side face portion can be any element which can shield electromagnetic waves, so a carbon material or a conductive paint is coated, or a copper foil covering on both sides of the antenna disk 21 is created so as to extend from the outermost circumference edge of the antenna disk 21 for the amount corresponding to the thickness of the antenna disk 21, then the extended copper foil is bent to the side face portions of the antenna disk 21 by pressing.

On the feeder disk 23, four through holes 24 of which the centers are the central axis of the four markers 22 (circular shape), created on the rear side of the antenna disk 21 respectively, are disposed (see FIG. 7*a*). Of the through holes 24, the diameter of the hole on the front side of the feeder disk 23 is 0.05λ+100 μm, for example. And the diameter of the hole on the rear side is 0.05λ+500 μm, so the cross-section has an upside down funnel shape, as shown in FIG. 7*d*. The diameter of the hole on the rear side is larger in order to make a visual check easier when the markers 22 on the antenna disk 21 are looked through.

The feeder disk 23 is created by processing brass material with a 5 mm or more thickness, for example, by a lathe or drilling machine. The material is not limited to brass, and any material which can implement mechanical strength and RLS antenna radiation directivity 16 after completion, as shown in FIG. 4*b* may be used, or aluminum material or a conductive plastic material which is mechanically processed by a lathe or drilling machine may be used.

Now the assembly of the RLS antenna of the first embodiment will be described. This assembly is basically the same as prior art, so assembly will be described with reference to the above mentioned FIG. 4 and FIG. 5 again.

At first, the antenna disk 21 is placed inside the side stopper 6 of the feeder disk 23 so that the front side of the feeder disk 23 and the rear side of the antenna disk 21 match. In this case, the center of the antenna disk 21 and the center of the feeder disk 23 are matched by the side stopper 6. Since the angle of the perturbation element 3*b* of the first feeder section 3 created on the rear side of the antenna disk 21 is not the predetermined angle θ in this case, the circular markers 22, created on the antenna disk 21, are visually searched for through the through holes 24 created on the feeder disk 23.

Figure 5:
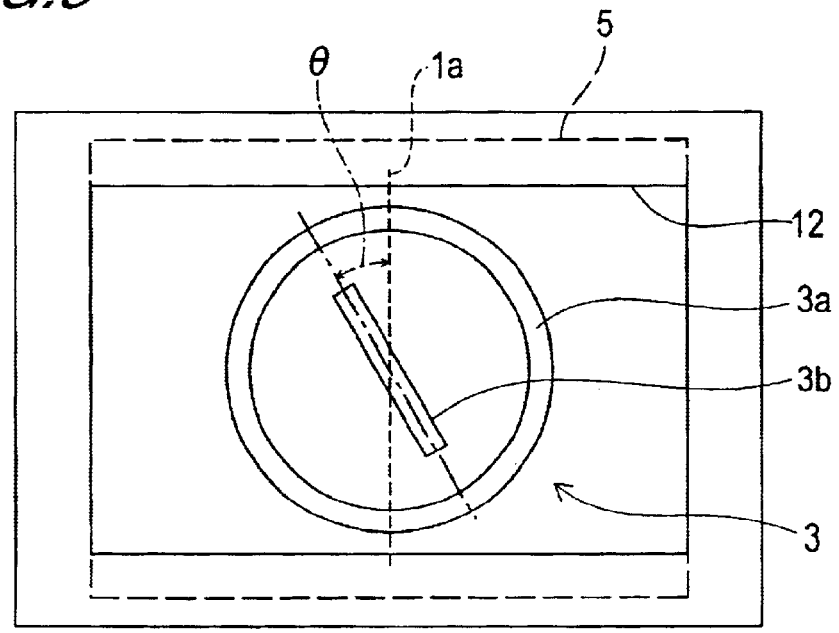
FIG. 5 is a plan view depicting an enlarged positional relationship between the feeder section of the antenna disk, the feeder section of the feeder disk, and the opening of the feeder wave guide.

In this case, the feeder section 5 of the feeder disk 23 and the perturbation element 3*b* of the antenna disk 21 are set to have the positional relationship of the above mentioned prior art shown in FIG. 5, for example. And either the antenna disk 21 or the feeder disk 23 is rotated and the above mentioned markers 22 are visually searched for through the through holes 24 of the feeder disk 23. When each one of the markers 22 are visually checked through each one of the through holes 24 respectively, the feeder section 5 and the antenna disk 21 are set or aligned to the center with which the circular shape of the markers 22 and each hole of the through holes 24 match. Then the antenna disk 21 and the feeder disk 23 are electrically connected by a conductive adhesive or a conductive adhesive sheet.

For this bonding, a liquid conductive adhesive or a conductive adhesive sheet, which initially is not adhesive, is used, and the antenna disk 21 and the feeder disk 23 are bonded by air drying or heating after the above mentioned alignment. A liquid conductive adhesive may be entered through the gap at the bonding section between the antenna disk 21 and the feeder disk 23 using capillarity after alignment.

If the center of each marker 22 is set to be the center of the respective through hole 24 when each marker 22 is visually checked through the corresponding through hole 24, then the RLS antenna characteristics become predetermined values. In other words, the angle of the perturbation element 3*b* is set to be a predetermined angle θ and it is unnecessary to confirm the reflection loss characteristic or the impedance characteristic of the antenna, for example, so that the perturbation element 3*b* is set to the predetermined angle θ, as in the case of the above mentioned prior art. As a result, the RLS antenna can be easily and quickly adjusted merely by a visual check.

Then the pins 13 of the feeder wave guide 11 are inserted into the pin holes 8 created on the feeder disk 23 respectively, so that the direction of the second feeder section 5 of the feeder disk 23, on which the antenna disk 21 is mounted, and the opening 12 of the feeder wave guide 11, match. And the screws 15 are screwed into the screw holes 9 of the feeder disk 23 respectively via the four screw holes 14 created on the feeder wave guide 11, in order to secure the feeder wave guide 11 to the feeder disk 23 on which the antenna disk 21 is mounted.

As the above description clearly shows according to the first embodiment, the second feeder section 5 of the feeder disk 23, the ring slot 3*a* and the perturbation element 3*b* of the antenna disk 21 have an optimum positional relationship when the markers 22, created on the rear side of the antenna disk 21, are set to the centers of the through holes 24 created on the feeder disk 23. As a result, the optimum positional relationship between the second feeder section of the feeder disk and the first feeder section of the antenna disk can be adjusted simply and quickly even by a visual check, which makes mounting of the antenna disk easier and makes mass production of RLS antennas possible, decreases cost thereof and increases performance.

Also according to the first embodiment, the second feeder section 5 of the feeder disk 23, the ring slot 3*a* and the perturbation element 3*b* of the antenna disk 21 are set to a high accuracy positional relationship, so the input impedance characteristic is set appropriately, and RLS antenna characteristics in general can be dramatically improved, the axial ratio, which is one important characteristic of an antenna, is decreased, and antenna characteristics with extremely fine circular polarized radiation can be implemented.

The above mentioned RLS antenna can be used for millimeter wave communication for such applications as Electronic Toll Collection (ETC) Systems, ITS, and indoor LAN, but the frequency band of the RLS antenna may be changed from the millimeter wave band to a sub-millimeter wave band or to a microwave wave band. In this case, the size of the antenna disk increases, but the alignment accuracy of the second feeder section and the ring slot for the feeder and perturbation element further improves, and the gain and axial ratio of the antenna are further improved. In other words, application can be expanded.

If the number of slots arranged on the antenna disk is increased, the radiation gain characteristic further improves, and the main beam width (half angle) becomes sharp. Therefore the antenna disk can be used for a system which requires a high gain antenna, such as a parabola antenna.

Examples of such applications are antennas for the relay of telephone communication stations, antennas for the relay of TV stations, antennas for satellite communication, and antennas for radio telescopes.

Second Embodiment

Figure 8:
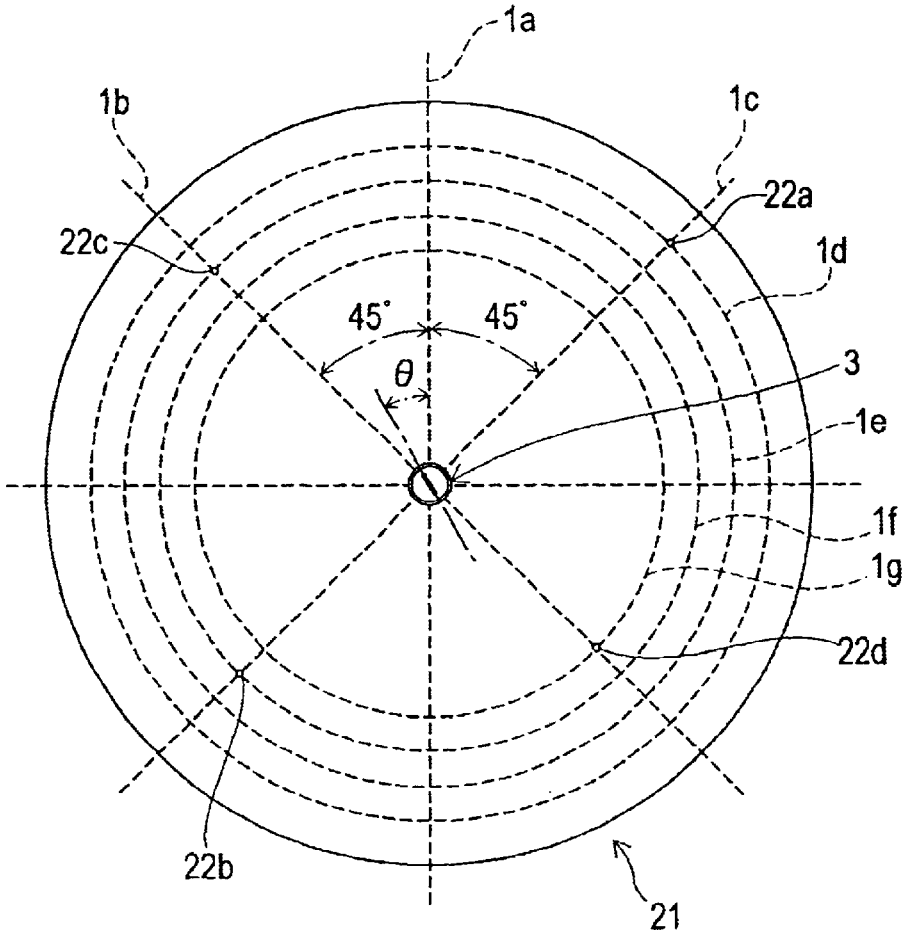
FIG. 8 is a plan view depicting the general configuration of the rear side of the RLS antenna disk according to the second embodiment of the present invention.

FIG. 8 is a plan view depicting the general configuration of the rear side of the antenna disk in the RLS antenna according to the second embodiment of the present invention.

FIG. 9*a*–FIG. 9*f* are diagrams depicting the configuration of the RLS antenna feeder disk according to the second embodiment. FIG. 9*a* is a plan view depicting the configuration of the front side of the feeder disk, and FIG. 9*b* is a diagram depicting the configuration of the A-A' cutting plane of the feeder disk. FIG. 9*c* is a diagram depicting the configuration of the C-C' cutting plane of the feeder disk, and FIG. 9*d* is a diagram depicting the configuration of the D-D' cutting plane of the feeder disk. FIG. 9*e* is a diagram depicting the configuration of the B-B' cutting plane of the feeder disk, and FIG. 9*f* is a plan view depicting the configuration of the rear side of the feeder disk.

In the second embodiment, composing elements identical with or equivalent to the above mentioned first embodiment described with reference to FIG. 6 and FIG. 7 are denoted with identical reference numerals, for which redundant descriptions are omitted.

In the RLS antenna of the second embodiment, the first feeder section 3, which comprises a ring slot 3*a* and perturbation element 3*b* at the center and circular markers 22*a*, 22*b*, 22*c* and 22*d* with a 0.05λ diameter, for example, created by etching processing, which are arranged from the center to the circumference direction, are disposed on the rear side of the antenna disk 21, just like the first embodiment.

The marker 22*a* is placed at an intersection between a virtual principal line 1*c*, which is perpendicular to the central axis of the antenna disk 21, and a virtual circumference 1*d* with a radius of 0.5 (D−2λ) of which the center is the central axis, for example. The marker 22*b* is placed at an intersection between the above mentioned principal line 1*c* and a virtual circumference 1*f* with a radius of 0.5 (D−2λ)−1000 μm. The marker 22*c* is placed at an intersection between a virtual principal line 1*b*, which is perpendicular to the central axis of the antenna disk 21, and a virtual circumference 1*e* with a radius of 0.5 (D−2λ)−500 μm, of which the center is the central axis thereof. And the marker 22*d* is placed at an intersection between the above mentioned principle line 1*b* and a virtual circumference 1*g* with a radius of 0.5 (D−2λ)−1500 μm.

The above mentioned "D" is a diameter of the antenna disk 21, and "λ" is a wavelength of the central frequency of the RLS antenna.

For example, when the frequency is 40 GHz, the diameter of the markers 22*a*–22*d* is about 300 μm. Therefore if the distance from the center of the antenna disk 21 is sequentially changed in 500 μm units, as described above, the markers 22*a*–22*d* can be visually checked, as described above. In this case, the positional relationship can be recognized more easily in the second embodiment compared with the first embodiment.

On the feeder disk 23, four through holes 24*a*–24*d* are created corresponding to the markers 22*a*–22*d* created on the rear side of the antenna disk 21 respectively (see FIG. 9*a*). For example, the through hole 24*a* is placed at an intersection between a virtual principal line 1*c*, which is perpendicular to the central axis of the feeder disk 23, and a virtual circumference 1*d* with a radius of 0.5 (D−2λ) of which the center is the central axis thereof. The through hole 24*b* is placed at an intersection between the above mentioned principal line 1*c* and a virtual circumference 1*f* with a radius of 0.5 (D−2λ)−1000 μm. The through hole 24*c* is placed at an intersection between a virtual principal line 1*b*, which is perpendicular to the central axis of the feeder disk 23, and a virtual circumference 1*e* with a radius of 0.5 (D−2λ)−500 μm of which the center is the central axis thereof. The through hole 24*d* is placed at an intersection between the above mentioned principal line 1*b* and a virtual circumference 1*g* with a radius of 0.5 (D−2λ)−1500 μm.

For each one of the through holes 24*a*–24*d*, the diameter of the hole on the front side of the feeder disk 23 is 0.05λ+100 μm, and the diameter of the hole on the rear side is 0.05λ+500 μm, just like the first embodiment. So the cross section of the hole is an upside down funnel shape, as shown in FIG. 9*d* and FIG. 9*e*.

In this way, if the feeder disk 23, on which through holes 24*a*–24*d* are arranged, is 180 degrees inverted with the above mentioned principal line 1*a* as the axis, and is aligned so as to face the rear side of the antenna disk 21 shown in FIG. 8, then the marker 22*a* can be visually checked through the through hole 24*a*. The marker 22*b* can be visually checked through the through hole 24*b*, and the marker 22*c* can be visually checked through the through hole 24*c*. And the marker 22*d* can be visually checked through the through hole 24*d*.

In this way, according to the second embodiment, the only position, with which the antenna disk 21 and the feeder disk 23 correctly match, is the position where each one of the markers 22*a*–22*d*, created on the rear side of the antenna disk 21, and each one of the through holes 24*a*–24*d*, created on the feeder disk 23, perfectly match. So no error occurs to the positional relationship of the feeder section 5 of the feeder disk 23 and the ring slot 3*a* and the perturbation element 3*b* of the antenna disk 21, and assembly becomes easier, quicker and with certainty.

As a result, the optimum positional relationship between the feeder section of the feeder disk and the feeder section of the antenna disk can be adjusted simply and quickly by a visual check, which makes mounting of the antenna disk easier, makes mass production of RLS antennas possible, further decreases cost and increases performance.

Also just like the first embodiment, processing accuracy is high, so the ring slot 3*a* and the perturbation element 3*b* of the antenna disk 21 and the markers 22*a*, 22*b*, 22*c* and 22*d* can be arranged at the center of the second feeder section 5 of the feeder disk 23 at high accuracy with a predetermined angle θ, easily, quickly and with certainty.

Third Embodiment

In the third embodiment, the feeder disk 23 is created by conductivity-added plastic mold, while in the first and second embodiment, the feeder disk 23 is created from brass material, aluminum material or conductive plastic material, which is mechanically processed using a lathe or drilling machine.

For the conductivity-added plastic molding, engineering plastic material (e.g. liquid crystal polymer, polysultone, polyether sulfone, polyphenylene sulfide, polyether ether ketone, polyallylate, polyether imide) is used. To add conductivity, carbon material or conductive paint is coated on the feeder disk 23 created by plastic mold, or a metal coat, such as aluminum, is deposited.

The feeder disk 23 may be created by molding the conductive plastic material (e.g. polyacetylene, polyaniline, polythiophene, polypyrrole, and other polymers) so that processing after the above mentioned "add conductivity" step is unnecessary.

According to the third embodiment, the feeder disk 23 shown in the first and second embodiments is created using brass material, aluminum material or conductive plastic material, and need not be created using a lathe, which is time consuming. In other words, mass production becomes easier and weight becomes lighter.

Fourth Embodiment

FIG. 10*a*–FIG. 10*e* are diagrams depicting the RLS antenna feeder disk according to the fourth embodiment of the present invention.

FIG. 10*a* is a plan view depicting the configuration of the front side of the feeder disk, and FIG. 10*b* is a diagram depicting the configuration of the A-A' cutting plane of the feeder disk. FIG. 10*c* is a diagram depicting the configuration of the C-C' cutting plane of the feeder disk, FIG. 10*d* is a configuration of the D-D' cutting plane of the feeder disk, FIG. 10*e* is a configuration of the B-B' cutting plane of the feeder disk and FIG. 10*f* is a plan view depicting the configuration of the rear side of the feeder disk.

Figure 11:
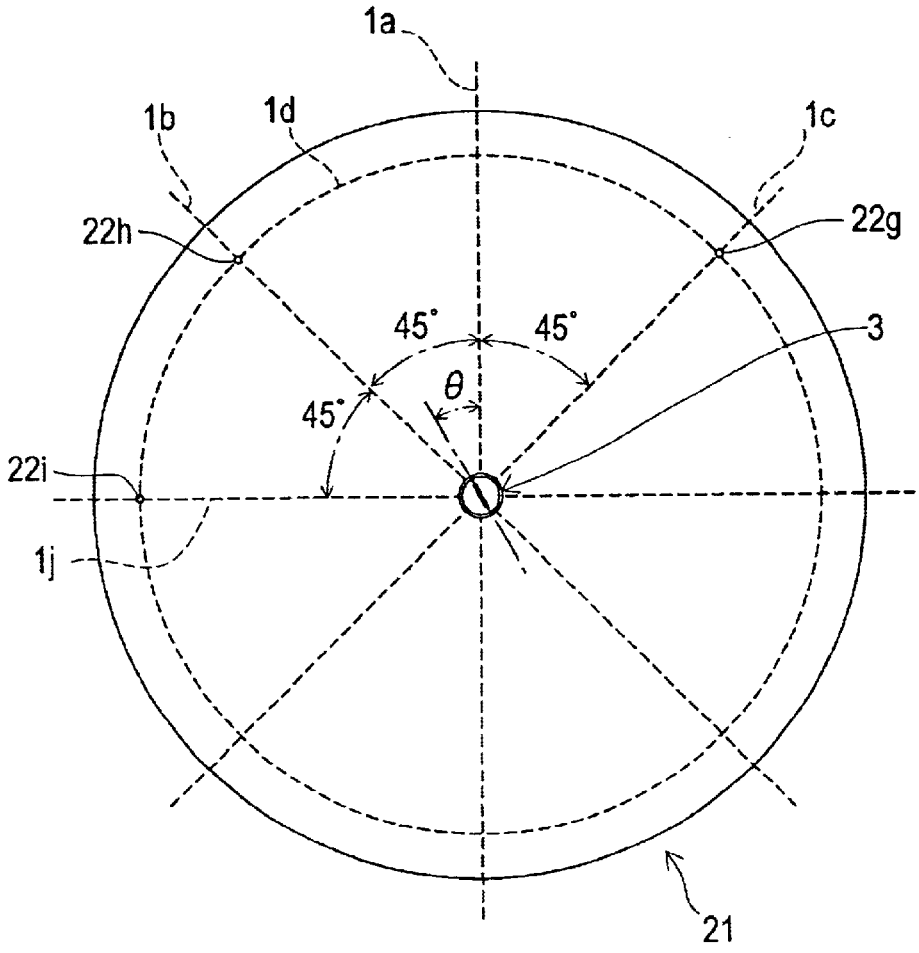
FIG. 11 is a diagram depicting the general configuration of the rear side of the RLS antenna disk according to the fourth embodiment.

FIG. 11 is a diagram depicting the general configuration of the rear side of the RLS antenna disk according to the fourth embodiment.

In the fourth embodiment, composing elements identical with or equivalent to the above mentioned first embodiment described with reference to FIG. 6 and FIG. 7 are denoted with the same reference numerals, for which redundant descriptions are omitted.

In the RLS antenna of the fourth embodiment, the feeder disk 23 shown in FIG. 10 is created with brass material, aluminum material or conductive plastic material which is processed mechanically using a lathe or drilling machine, just like the first and second embodiments. Or the feeder disk 23 of the fourth embodiment is created with engineering plastic material by molding on which carbon material or conductive paint is coated, or a metal coat such as aluminum is deposited, as described in the third embodiment.

The feeder disk 23 may be created by molding the conductive plastic material, as described in the third embodiment.

The antenna disk 21 shown in FIG. 11 has basically the same configuration as the first and second embodiments, and is created in the same way. In the antenna disk 21 of the fourth embodiment, the feeder section 3, which comprises a ring slot 3*a* and perturbation element 3*b* at the center, and circular pattern markers 22*g*, 22*h* and 22*i* with a 0.05λ diameter, for example, created by etching processing, which are arranged from the center to the circumference direction, are deposited on the rear side of the antenna disk 21, just like the first embodiment.

The markers 22*g*–22*i* are arranged on the virtual circumference 1*d*. The marker 22*g* is placed at an intersection between a virtual principal line 1*c*, which is perpendicular to the central axis of the antenna disk 21 and a virtual circumference 1*d* with a radius of 0.5 (D−2λ) of which the center is the central axis thereof. The marker 22*h* is placed at an intersection between the above mentioned principal line 1*b* and a virtual circumference 1*d* with a radius of 0.5 (D−2λ)−1000 μm. The marker 22*i* is placed at an intersection between a virtual principal line 1*j* and a virtual circumference 1*d* with a radius of 0.5 (D−2λ) of which the center is the central axis thereof.

Corresponding to each arrangement of the markers 22*g*–22*i* of the antenna disk 21, three through holes, 24*g*, 24*h* and 24*i* are disposed on the feeder disk 23 as shown in FIG. 10.

Of the through holes 24*g*–24*i*, the through hole 24*g* is placed at an intersection between a virtual principal line 1*c* which is perpendicular to the center axis of the feeder disk 23, and a virtual circumference 1*d* with a radius of 0.5 (D−2λ) of which the center is the central axis thereof. The through hole 24*h* is placed at an intersection between the above mentioned principal line 1*c* and a virtual circumference 1*d* with a radius of 0.5 (D−2λ)−1000 μm, and the through hole 24*g* and the through hole 24*h* are arranged so as to form a 45° angle respectively (90° angle) with the principle line 1*a* as an axis. The through hole 24*i* is placed at an intersection between the above mentioned principal line 1*b* and a virtual circumference 1*d* with a radius of 0.5 (D−2λ)−1000 μm, and the through hole 24*i* and the through hole 24*h* are arranged to form 45°.

For the through holes 24*g*–24*i*, just like the first embodiment, the diameter of the hole on the front side of the feeder disk 23 is 0.05λ+100 μm, and the diameter of the hole on the rear side is 0.05λ+500 μm. Therefore the cross section of the hole is an upside down funnel shape, as shown in FIG. 10*d*.

If the rear face of the antenna disk 21, shown in FIG. 11, is aligned with the feeder disk 23 on which the through holes 24*g*–24*i* are arranged respectively, the marker 22*g* can be visually checked through the through hole 24*g*. In the same way, the marker 22*h* can be visually checked through the through hole 24*h*, and the marker 22*i* can be visually checked through the through hole 24*i*.

In this way, according to the fourth embodiment, there is only one position where the markers 22*g*–22*i*, created on the rear side of the antenna disk 21, and the through holes 24*g*–24*i* disposed on the feeder disk 23 perfectly match respectively. Therefore assembly is easier and quicker without causing error in the positional relationship between the feeder section 5 of the feeder disk 23 and the ring slot 3*a* and the perturbation element 3*b* of the antenna disk 21. As a result, an optimum positional relationship between the feeder section of the feeder disk and the feeder section of the antenna disk can be adjusted simply, even by a visual check, which makes mounting of the antenna disk easier, improves mass production of RLS antennas, decreases cost and increases performance.

Fifth Embodiment

FIG. 12*a*–FIG. 12*e* are diagrams depicting the general configuration of the RLS antenna feeder disk according to the fifth embodiment of the present invention.

FIG. 12*a* is a plan view depicting the configuration of the front side of the feeder disk, and FIG. 12*b* is a diagram depicting the configuration of the A-A' cutting plane of the feeder disk. FIG. 12*c* is a diagram depicting the configuration of the C-C' cutting plane of the feeder disk, and FIG. 12*d* is a diagram depicting the B-B' cutting plane and the D-D' cutting plane of the feeder disk. And FIG. 12*e* is a plan view depicting the configuration of the rear side of the feeder disk.

Figure 13:
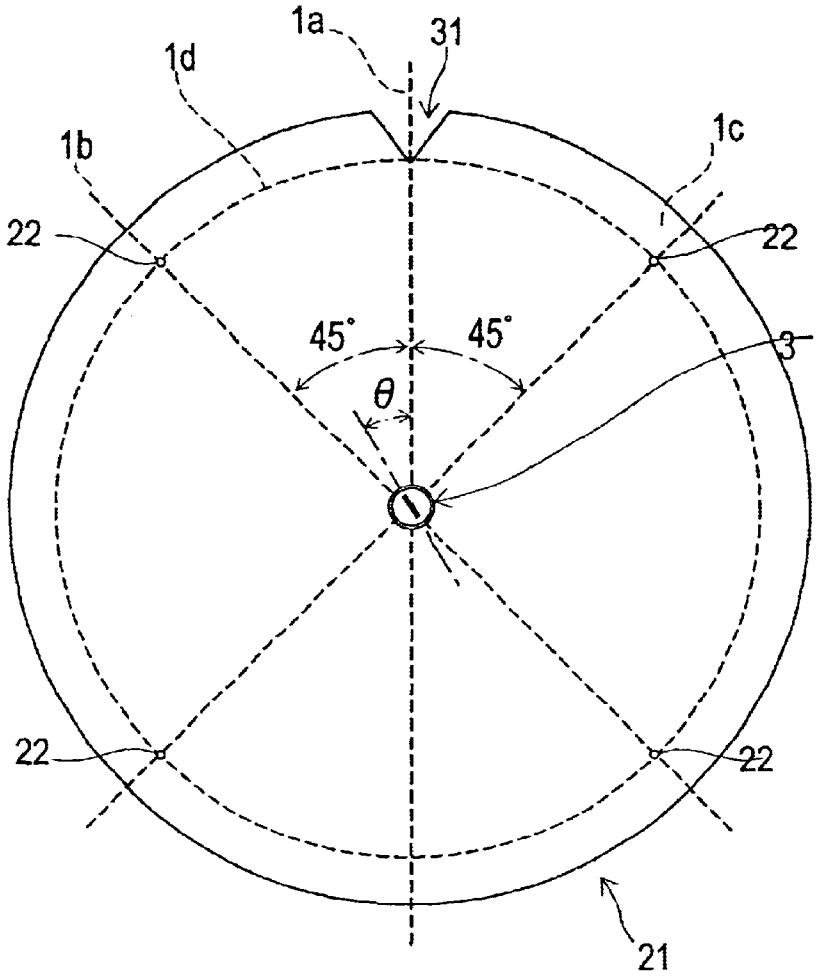
FIG. 13 is a diagram depicting the general configuration of the rear side of the RLS antenna disk according to the fifth embodiment.
Figure 15:
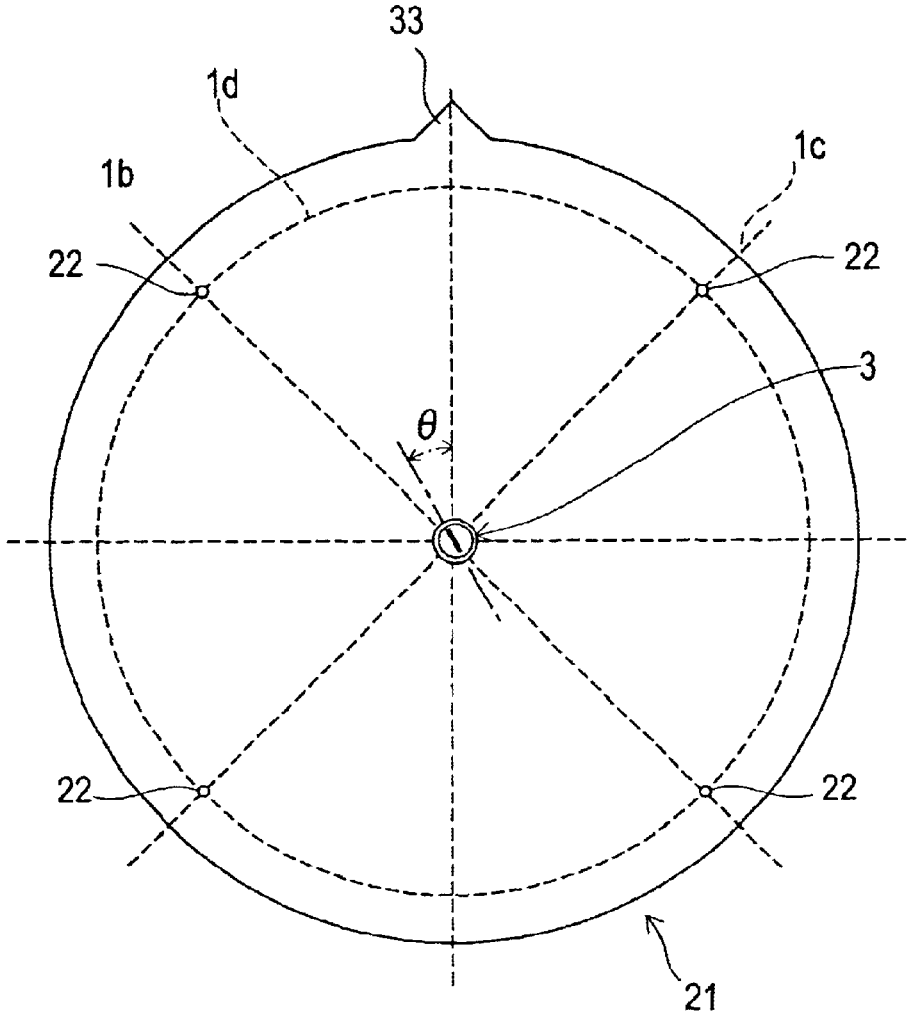
FIG. 15 is a diagram corresponding to FIG. 13, depicting another configuration example of the RLS antenna disk.

FIG. 13 is a plan view depicting the general configuration of the rear side of the RLS antenna disk according to the fifth embodiment.

The fifth embodiment can be applied to the first to fourth embodiments. Herein below, the fifth embodiment, which is applied to the above mentioned first embodiment shown in FIG. 6 and FIG. 7, is described. In the fifth embodiment in this application example, composing elements identical with or equivalent to the first embodiment are denoted with the same reference numerals, for which redundant descriptions are omitted.

In the RLS antenna of the fifth embodiment, it is preferable that the feeder disk 23 shown in FIG. 12 is created with engineering plastic material, which is molded and a conductive paint is coated or a metal coat such as aluminum is deposited as shown in the third embodiment, or created with conductive plastic material which is molded, as described in the third embodiment.

The feeder disk 23 shown in FIG. 12 has a protrusion 30 at the tip of the figure. In this example, this protrusion 30 is created so as to stick out in a triangular shape to the front side of the feeder disk 23.

The antenna disk 21 shown in FIG. 13 has a notch 31, which has a shape to fit with the protrusion 30, triangular shape in this example, at a position corresponding to the protrusion 30 of the above mentioned feeder disk 23.

In this case, the notch 31 to fit with the protrusion 30 has dimensions which allows an easy fit. When the antenna disk 21 is positioned on the feeder disk 23, the notch 31 of the antenna disk 21 is fitted with the protrusion 30 of the feeder disk 23. Then just like the first embodiment, the markers 22 of the antenna disk 21 and the through holes 24 are aligned with a visual check.

In this way, according to the fifth embodiment, the positional relationship when the antenna disk 21 is positioned on the feeder disk 23 can be discerned very easily by a visual check, so operability during assembly improves. As a result, mass production of RLS antennas further improves, and cost can be decreased with certainty.

FIG. 14*a*–FIG. 14*e* are diagrams depicting the configuration of the RLS antenna feeder disk according to the sixth embodiment of the present invention.

FIG. 14*a* is a plan view depicting the configuration of the front side of the feeder disk, and FIG. 14*b* is a diagram depicting the configuration of the A-A' cutting plane of the feeder disk. FIG. 14*c* is a diagram depicting the C-C' cutting plane of the feeder disk, and FIG. 14*d* is a diagram depicting the configuration of the B-B' cutting plane and the configuration of the D-D' cutting plane of the feeder disk. And FIG. 14*e* is a plan view depicting the configuration of the rear side of the feeder disk.

In the fifth embodiment, the protrusion 30 of the feeder disk 23 is fitted into the notch 31 created on the antenna disk 21. Whereas in the sixth embodiment, the antenna disk 21 has a protrusion for latching 33, which sticks out from the edge to the radiation direction.

The feeder disk 23, on the other hand, has a latch 38 where the protrusion for latching 33 of the antenna disk is fitted and latched, instead of the triangular protrusion 30.

This latch 38 is created at a position corresponding to the protrusion for latching 33 by processing the edge of the adjacent side stopper 36 so as to be latched with the protrusion for latching 33. In the sixth embodiment, the size of the entire feeder disk 23 is set such that the entire body of the antenna disk 21, including the protrusion for latching 33, can fit inside the side stopper 36 on the front side of the feeder disk 23. Therefore in this configuration example, the side stopper 36 is created wider throughout the entire feeder disk 23, unlike the case of the above mentioned embodiments.

Variant Forms

In the first embodiment, four markers 22 are disposed in the circumference direction at positions where the distance from the center of the antenna disk 21 is 0.5 (D−2λ). In the second embodiment, four markers 22*a*–22*d* are disposed in the circumference direction in the area where the distance from the center of the antenna disk 21 is between 0.5 (D−2λ) and 0.5 (D−2λ)−1500 μm, but the markers may be disposed any place in the area range where the distance from the center of the antenna disk 21 is between 0.5 (D−4λ) and 0.5 D, only if alignment can be performed easily. This can be applied to the third to fifth embodiments in the same way.

The shape of the marker is circular, but does not have to be circular only if the maximum size is about 0.1λ. For example, an ellipse, star or polygon shape can be used only if it can be created by etching processing.

In the first embodiment, the number of markers for alignment is four, but this is not limited but can be any number if alignment can be performed easily. In the above descriptions, the through hole for checking markers has an upside down funnel shape, but this is not limited, but the through hole may have any shape if alignment can be easily confirmed by a visual check of the markers by visually looking through the through hole.

Instead of creating the notch 31 on the antenna disk, as shown in FIG. 13, the protrusion for latching 33, which sticks out from the outer edge of the antenna disk 21 in the radius direction, may be created as shown in FIG. 14. In this case, the sizes of the feeder disk 23 and the antenna disk 21 shown in FIG. 12*a* and FIG. 12*b* are adjusted in advance, and when the antenna disk 21 is positioned on the feeder disk 23, the protrusion for latching 33 of the antenna disk 21 and the protrusion 38 of the feeder disk 23 (indicated by the dotted line in FIG. 14) can come next to each other and engage. If this configuration is used, an impedance mismatch can be decreased compared with the case when the antenna disk 21 is positioned on the feeder disk 23 with the notch 31.

To embody the above mentioned radial line slot antenna of the present invention, the following configuration is preferable.

What is claimed is:

1. A radial line slot antenna, comprising:

an antenna disk which has a slot element for transmitting/receiving electromagnetic waves on the front side and has a feeder section at the center of the rear side which is the opposite side of the front side; and a feeder disk where said antenna disk is mounted contacting the rear side thereof, and a feeder section for transmitting/receiving electromagnetic wave signals to/from said antenna disk is disposed, wherein when the diameter of said antenna disk is D and the wavelength of the central frequency is λ, a marker with a maximum size of about 0.10λ or less is disposed at an area or distance of about 0.5 (D−λ) to 0.5 D from the center on the rear side of said antenna disk, and said feeder disk further comprises a through hole with a size sufficient to view said marker at a position the same as the position of said marker, and said marker is a marker for positioning the antenna disk on said feeder disk after confirming that said marker is positioned at the center of said through hole.

2. The radial line slot antenna according to claim 1, wherein one or two or more said markers are created on a same circumference in said area or distant from the center of said antenna disk, and said through holes are disposed corresponding to the positions of the respective markers.

3. The radial line slot antenna according to claim 2, wherein a plurality of said markers disposed on said same circumference are disposed at an equal interval or different interval on a cocentric circumference, and said through holes are disposed corresponding to the positions of said markers respectively.

4. The radial line slot antenna according to claim 1, wherein one or two or more said markers are created on different circumferenecs in said area or distant from the center of said antenna disk, and said through holes are disposed corresponding to the positions of the respective markers.

5. The radial line slot antenna according to claim 4, wherein one or two or more said markers created on said different circumferences are created on different circumferences at an equal interval or different interval, and said through holes are disposed corresponding to the positions of said markers respectively.

6. The radial line slot antenna according to claim 1, wherein said marker has a cross-sectional shape perpendicular to the longitudinal direction of the through hole of the feeder disk, including a circular, ellipse, star or polygon shape.

7. The radial line slot antenna according to claim 1, wherein in the through hole created on said feeder disk, an opening area of the shape created on the front side of said feeder disk, on which the rear side of said antenna disk contacts, is smaller than the opening area of the shape created on the rear side which is the viewing side.

8. The radial line slot antenna according to claim 1, wherein said antenna disk further comprises a slot element and a feeder section on a member which is dielectric on which metallic foil is disposed.

9. The radial line slot antenna according to claim 8, wherein said member which is dielectric on which metallic foil is disposed is a printed board which is dielectric on which copper foil is pasted.

10. The radial line slot antenna according to claim 1, wherein a conductor is disposed around the edge of said antenna disk.

11. The radial line slot antenna according to claim 1, wherein the conductor around the edge of said antenna disk is said metal foil which is extended from the surface of said dielectric in the member which is dielectric on which metallic foil is disposed, or a conductive layer electrically connected with said metallic foil extended from the surface of said dielectric.

12. The radial line slot antenna according to claim 1, further comprising a positioning section wherein when said antenna disk is arranged on said feeder disk, the antenna disk is arranged at a predetermined position before confirming that said marker is positioned at the center of said through hole.

13. The radial line slot antenna according to claim 12, wherein said positioning section comprises a notch which is created at the edge of said antenna disk and a protrusion which is disposed on said feeder disk and is fitted into said notch.

14. The radial line slot antenna according to claim 12, wherein said positioning section further comprises a protrusion for latching which is created at the edge of said antenna disk, and a latch section which is disposed on said feeder disk and latches said protrusion for latching of said antenna.

* * * * *